US009323202B2

(12) United States Patent
Akimoto

(10) Patent No.: US 9,323,202 B2
(45) Date of Patent: Apr. 26, 2016

(54) PRINTING APPARATUS, METHOD FOR CONTROLLING THE SAME, AND STORAGE MEDIUM

(71) Applicant: CANON KABUSHIKI KAISHA, Tokyo (JP)

(72) Inventor: Naoto Akimoto, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 13/765,543

(22) Filed: Feb. 12, 2013

(65) Prior Publication Data

US 2013/0209113 A1 Aug. 15, 2013

(30) Foreign Application Priority Data

Feb. 14, 2012 (JP) ..... 2012-029126

(51) Int. Cl.
*G03G 15/00* (2006.01)
*G03G 21/16* (2006.01)

(52) U.S. Cl.
CPC ..... *G03G 15/607* (2013.01); *G03G 15/70* (2013.01); *G03G 21/1638* (2013.01); *G03G 2215/00548* (2013.01); *G03G 2221/1609* (2013.01)

(58) Field of Classification Search
CPC ..... G03G 15/70; G03G 2215/00548; G03G 2221/1609; G03G 5/551
USPC ..... 399/18, 21; 400/76
See application file for complete search history.

(56) References Cited

U.S. PATENT DOCUMENTS 5,678,138 A * 10/1997 Kobayashi et al. ..... 399/18
6,647,215 B1 * 11/2003 Ogle et al. ..... 399/13
7,454,145 B2 * 11/2008 Weaver et al. ..... 399/9
2008/0247768 A1 * 10/2008 Yamada ..... 399/21

FOREIGN PATENT DOCUMENTS

JP 5-145689 A 6/1993

* cited by examiner

*Primary Examiner* — Blake A Tankersley
*Assistant Examiner* — John M Royston
(74) *Attorney, Agent, or Firm* — Canon USA Inc. IP Division

(57) ABSTRACT

A printing apparatus notifies a user of a message that jamming may be attributed to a protective member yet to be removed, without providing any sensor for detecting the protective member. A method for controlling a printing apparatus that conveys a sheet includes detecting sheet jamming, determining a number of discharged sheets, and notifying the user to remove the protective member present on a conveyance path if the sheet jamming is detected and the number of discharged sheets is determined to be less than a predetermined number, and notifying the user of the sheet jamming if the sheet jamming is detected and the number of discharged sheets is determined to be equal to or greater than the predetermined number.

9 Claims, 7 Drawing Sheets

FIG. 5

SHEET IS JAMMED.
REMOVE THE SHEET.
701

ORANGE MEMBER REMAINS INSIDE THE APPARATUS.
REMOVE THE MEMBER, AND THEN PRESS OK KEY.
702

DO YOU WANT TO CONFIRM SHEET PASSING IN PRINTING UNIT?
IF YES→PRESS OK KEY. IF NO→PRESS CLEAR KEY.
703

HAS ORANGE MEMBER BEEN REMOVED?
IF YES, PRESS OK KEY.
704

PRINTING APPARATUS, METHOD FOR CONTROLLING THE SAME, AND STORAGE MEDIUM

BACKGROUND OF THE INVENTION

1. Field of the Invention

The present invention relates to a printing apparatus, a method for controlling the same, and a storage medium.

2. Description of the Related Art

A conventional printing apparatus displays, when an error occurs, a content of the error on a display unit such as a liquid crystal display (LCD), thereby prompting a user to eliminate the error (as discussed in Japanese Patent Application Laid-Open No. 5-145689). For example, when sheet jamming occurs during printing, the printing apparatus displays a message such as "Remove a jammed sheet" on the display unit to prompt the user to remove the jammed sheet.

However, even after the sheet has been removed by the user and yet a cause of the error remains, an error may occur again when the printing is resumed.

For example, if the error is caused because the user has not removed a protective member, which is disposed to protect the apparatus, printing cannot be normally carried out before the user removes the protective member. The protective member is a buffer member disposed to protect a member that conveys the sheet in the printing apparatus. The protective member can be easily removed by the user. A method for removing the protective member is described in an instruction manual.

Thus, even after the printing apparatus has displayed the message such as "Remove a jammed sheet" and the user has removed the jammed sheet, a jamming error may occur again during printing.

It is desirable for the printing apparatus to include a sensor that can physically detect presence of the protective member. However, due to a shape of the protective member or an installation position of the protective member, it is difficult in many cases to install the sensor.

SUMMARY OF THE INVENTION

According to an aspect of the present invention, a printing apparatus that conveys a sheet includes a detecting unit configured to detect sheet jamming, a determining unit configured to determine a number of discharged sheets, and a notification unit configured to notify a user of a message to remove a protective member present on a conveyance path if the detecting unit detects the sheet jamming and the determining unit determines that the number of discharged sheets is less than a predetermined number, and to notify the user of the sheet jamming if the detecting unit detects the sheet jamming and the determining unit determines that the number of discharged sheets is equal to or greater than the predetermined number.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5 is a diagram illustrating a message example displayed on a display illustrated in FIG. 1.

DESCRIPTION OF THE EMBODIMENTS

Various exemplary embodiments, features, and aspects of the invention will be described in detail below with reference to the drawings.

Figure 1:
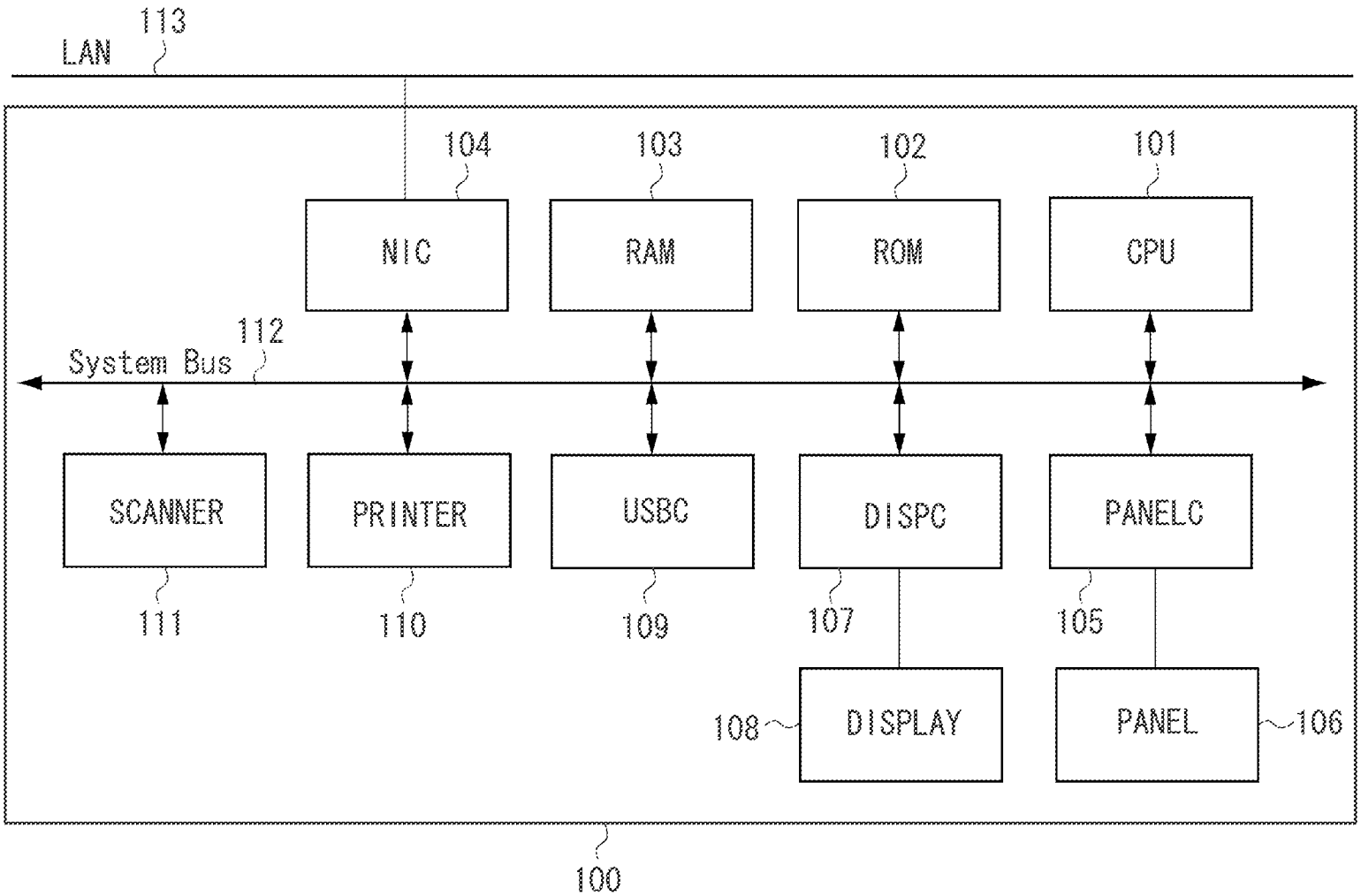
FIG. 1 is a block diagram illustrating a configuration of a printing apparatus according to an exemplary embodiment of the present invention.

FIG. 1 is a block diagram illustrating a configuration of a printing apparatus according to an exemplary embodiment. A multifunction peripheral (MFP) 100 is used as an example of the printing apparatus.

In FIG. 1, the MFP 100 includes a central processing unit (CPU) 101, a read-only memory (ROM) 102, a RAM 103, a network interface card (NIC) 104, an external input controller (PANELC) 105, and various buttons or a touch panel (PANEL) 106. The MFP 100 includes a display controller (DISPC) 107, a display (DISPLAY) 108, and a universal serial bus (USB) controller 109. The MFP 100 further includes a printing unit (PRINTER) 110 and a scanner unit (SCANNER) 111.

The CPU 101 illustrated in FIG. 1 controls devices connected to a system bus 112 overall, and executes a firmware module stored in the ROM 102. The firmware module includes at least two or more modules, and the firmware module can be updated by module.

Further, the CPU 101 carries out processing of each flowchart described below based on the firmware module as a control program. The RAM 103 functions as a main memory and a work area for the CPU 101, and is used as a backupable memory for storing apparatus setting.

The PANELC 105 controls an instruction inputting on the PANEL 106 included in the MFP. The DISPC 107 controls rendering on the DISPLAY 108. The USBC 108, which controls a device side USB interface, is connected to a personal computer (PC) via a USB cable.

The NIC 104 controls data transmission or reception with another PC or MFP via a local area network (LAN) 113. The PRINTER 110, which includes a sheet feeding unit (sheet feeding cassette), an image forming unit, and a sheet discharge unit (sheet discharge tray), forms an image on recording paper (sheet) fed form the sheet feeding unit in an electrophotography method by the image forming unit, and discharges the sheet to the sheet discharge unit. The CPU 101 controls sheet feeding from the sheet feeding unit, image formation by the image forming unit, and sheet discharging to the sheet discharge unit. The SCANNER 111 reads the image printed on the sheet. The SCANNER 111, on which an automatic document feeder (not illustrated) is mounted as an option, can automatically read a plurality of documents.

Figure 2:
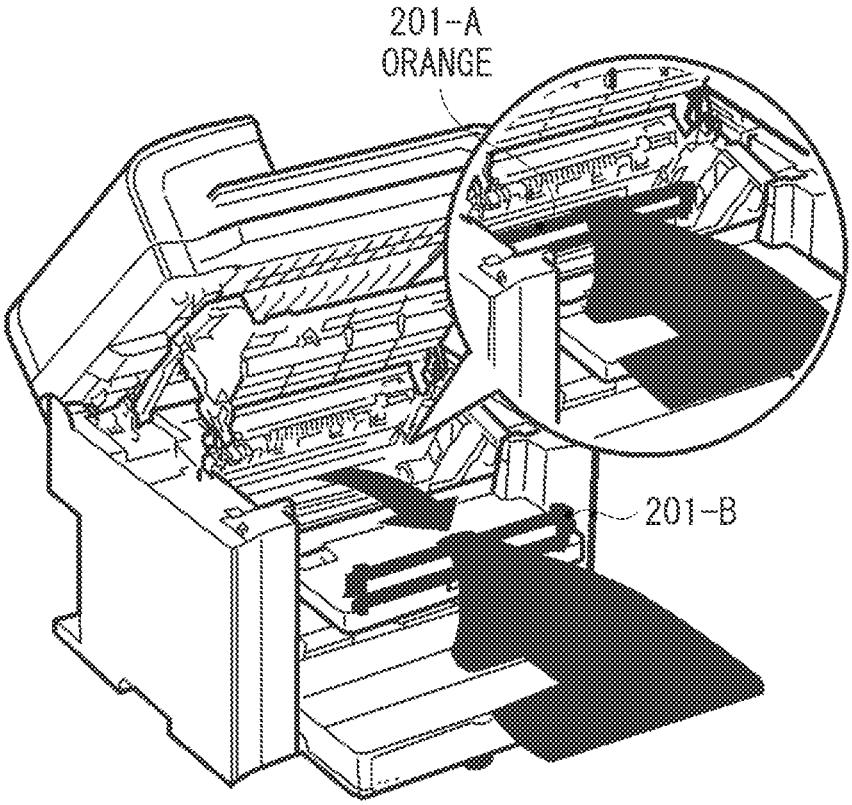
FIG. 2 is a perspective view illustrating a protective member placed in the printing apparatus illustrated in FIG. 1.

FIG. 2 is a perspective view illustrating an example of a protective member (packaging member) placed in the MFP 100 illustrated in FIG. 1. This example is a case where a toner cover upper side of the printing apparatus is opened by pressing an open/close button (not illustrated) to make a sheet conveyance path visible.

In FIG. 2, when the toner cover is opened to pull out a toner cartridge, a protective member 201-A (the upper portion is illustrated in an enlarged manner) is fixed to the back of the toner cartridge. The protective member 201-A is inserted into a portion between a drum and a transfer roller to prevent them from contacting each other. To clearly illustrate that the protective member 201-A is not necessary for operating the apparatus, the protective member is orange-colored. According to a general procedure for installation, the user starts the MFP 100 after removing the protective member 201-A (as illustrated in 201-B).

However, when the user uses the apparatus without removing the protective member 201-A, the sheet cannot pass through the path (conveyance path) because the protective member 201-A is disposed on the path through which the sheet passes. Consequently, the sheet is jammed on the path, and the CPU 101 detects a jamming error based on information output from a sensor (not illustrated). The sensor is disposed to monitor a state of the conveyed sheet in a normal printing operation. Thus, the CPU 101 cannot determine, only based on the output information of the sensor, whether the jamming error has occurred because the protective member has not been removed. Although it is desirable that a sensor for detecting the presence of the protective member be disposed, providing the sensor for detecting the presence of the protective member is difficult depending on a shape or an installation position of the protective member.

Figure 3:
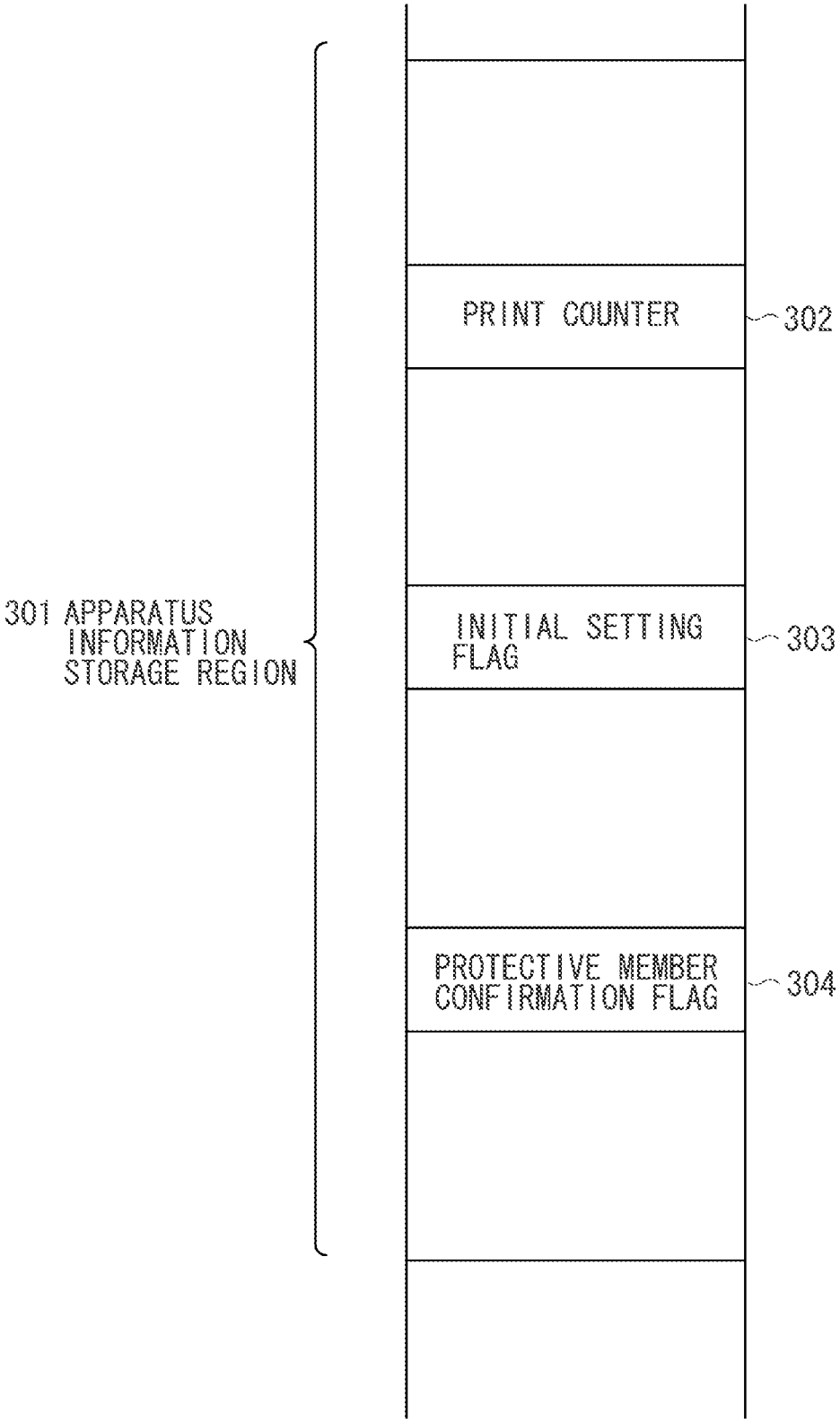
FIG. 3 is a diagram illustrating an example of information managed in a random access memory (RAM) illustrated in FIG. 1.

FIG. 3 is a diagram illustrating an example of information managed in the RAM 103 illustrated in FIG. 1. In this example, the RAM 103 has an apparatus information storage region 301, in which information (described in detail below) regarding an apparatus operation is stored. The RAM 103 is a nonvolatile memory (NVRAM) and, even when power of the MFP 100 is turned off, stored contents are not deleted.

In FIG. 3, pieces of information about a print counter 302, an initial setting flag 303, and a protective member confirmation flag 304 are stored in the apparatus information storage region 301.

The print counter 302 is a region for storing counter information recording the number of sheets printed by the MFP 100, and a value "0" is set at the time of factory shipment. The CPU 101 increments a count value (number of sheets) of the print counter 302 every time when one sheet on which an image has been printed is discharged. The CPU 101 detects completion of sheet discharging by the sensor disposed at a sheet discharge port. The initial setting flag 303 is a region for storing information about whether the MFP 100 has been initially set at the user side. At the time of factory shipment, "off (not have been initially set)" is set.

The protective member confirmation flag 304 is a region for storing information about whether the MFP 100 has received removal confirmation of the protective member from the user. At the time of factory shipment, "off (not confirmed)" is set. An information using method will be described referring to FIG. 6.

Figure 4:
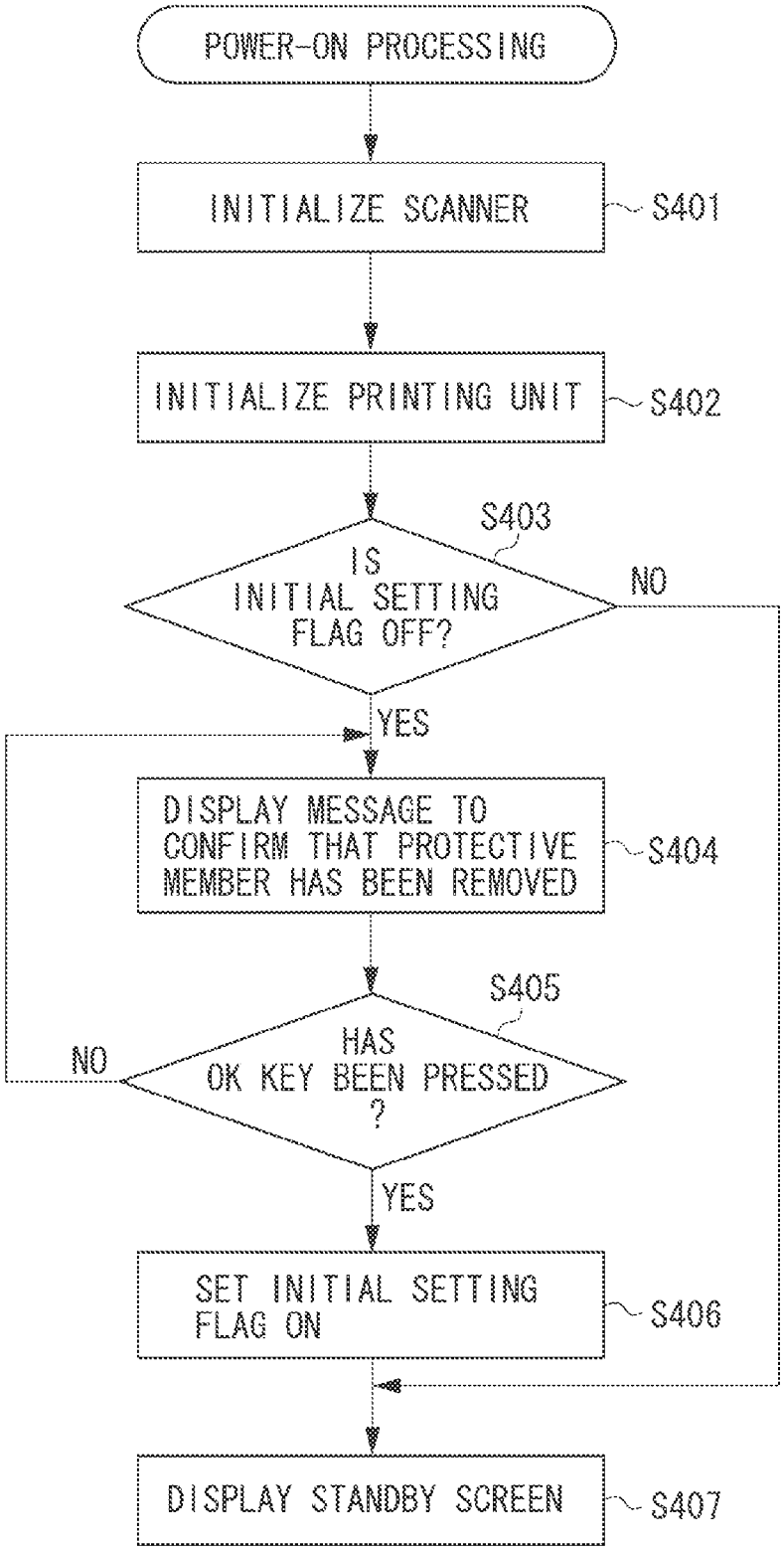
FIG. 4 is a flowchart illustrating a method for controlling the printing apparatus.

FIG. 4 is a flowchart illustrating a method for controlling the printing apparatus according to the present exemplary embodiment. This example is a control procedure when the power of the MFP 100 is turned on. Each step is realized in such a manner that the CPU 101 loads a control program stored in the ROM 102 to the RAM 103 to execute the program.

After the power has been turned on, in step S401, the CPU 101 initializes the scanner 111. The initialization includes processing for rotating a document conveyance roller for a predetermined time if a document feeder such as an automatic document feeder (ADF) is provided. Then, in step S402, the CPU 101 initializes the printer 110. This initialization includes processing for driving the roller for conveying the sheet for a predetermined time.

In step S403, the CPU 101 determines whether a setting value of the initial setting flag 303 disposed in the RAM 103 is currently "off". When it is determined that the setting value of the initial setting flag 303 is off (YES in step S403), then in step S404, the CPU 101 displays on the display 108 a message to confirm that the protective member has been removed. A message 704 illustrated in FIG. 5 is an example. The message 704 is used to confirm with the user whether the protective member has been removed. The message 704 instructs the user to press an OK key on the PANEL 106 after the confirmation.

When the CPU 101 determines that the setting value of the initial setting flag 303 is off (YES in step S403), the MFP 100 is used for the first time at the user side after the factory shipment, and thus a process for confirming whether the protective member has been removed is carried out.

In step S405, the CPU 101 determines whether the user has pressed the OK key on the PANEL 106. When it is determined that the user has not pressed the OK key on the PANEL 106 (NO in step S405), the CPU 101 returns the processing to step S405 to display a message again to confirm whether the protective member has been removed.

On the other hand, when it is determined that the user has pressed the OK key on the PANEL 106 (YES in step S405), then in step S406, the CPU 101 sets the setting value of the initial setting flag 303 disposed in the RAM 103 to "on". The overwritten setting value of the initial setting flag 303 is stored in a nonvolatile manner and is managed.

Then, in step S407, the CPU 101 ends the processing to be performed at the time of power-on, and displays a standby screen on the display 108 to end the processing.

On the other hand, when the CPU 101 determines that the setting value of the initial setting flag 303 disposed in the RAM 103 is not "off" (NO in step S403), this is not a case where the apparatus is activated for the first time after the factory shipment. Thus, the processing proceeds to step S407 to display the standby screen.

If the user carries out printing by using the MFP 100 without being aware of the message displayed in step s404, the printing is executed with the protective member illustrated in FIG. 2 not removed. Further, in the case of a MFP 100 having no mechanism of displaying a message to prompt the user to remove the protective member when the MFP 100 is powered on, printing is executed with the protective member illustrated in FIG. 2 not removed.

Figure 6:
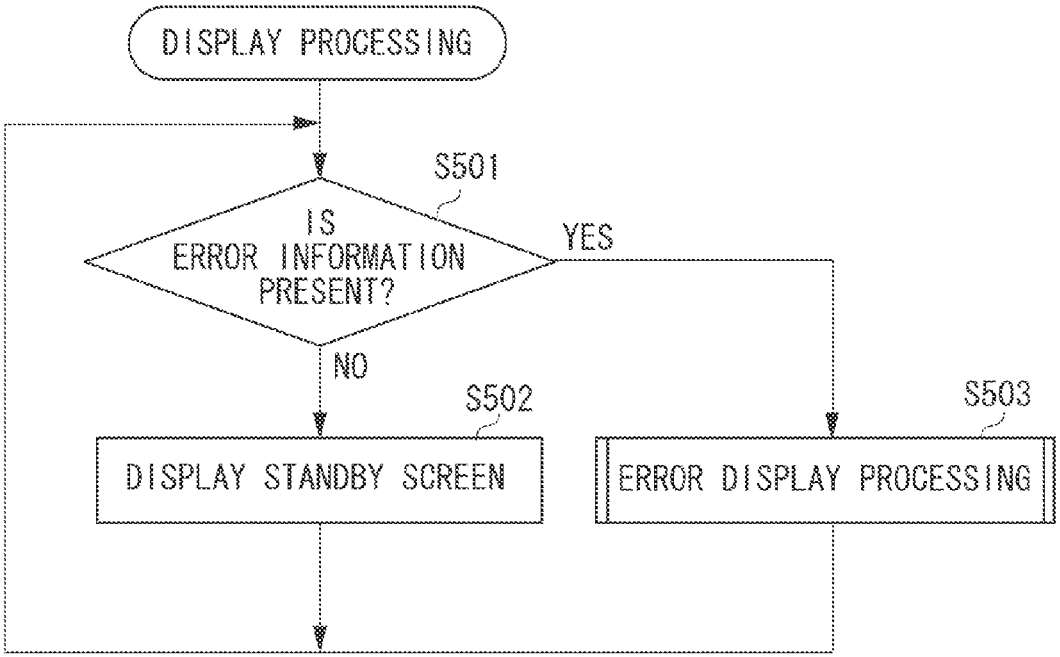
FIG. 6 is a flowchart illustrating a method for controlling the printing apparatus.

FIG. 6 is a flowchart illustrating a method for controlling the MFP 100 according to the present exemplary embodiment. This example is a processing procedure carried out while the MFP 100 is in a standby state or printing is stopped due to jamming. Each step is realized in such a manner that the CPU 101 loads the control program to the RAM 103 to execute the program.

First, in step S501, the CPU 101 determines whether an error has occurred using the sensor in the MFP 100. For example, jamming is detected by a plurality of sensors. After a sensor has detected a sheet passing, if a next sensor does not detect the sheet passing for a predetermined time, the CPU 101 determines that a jamming error has occurred. If a sensor provided in the sheet feeding cassette detects the absence of a sheet in the sheet feeding cassette, the CPU 101 determines that an error has occurred due to no sheet. When it is determined that an error has occurred (YES in step S501), then in step S503, the CPU 101 displays the error, and the processing returns to step S501.

On the other hand, when it is determined that no error has occurred (NO in step S501), then in step S502, the CPU 101 displays the standby screen, and the processing returns to step S501.

Figure 7:
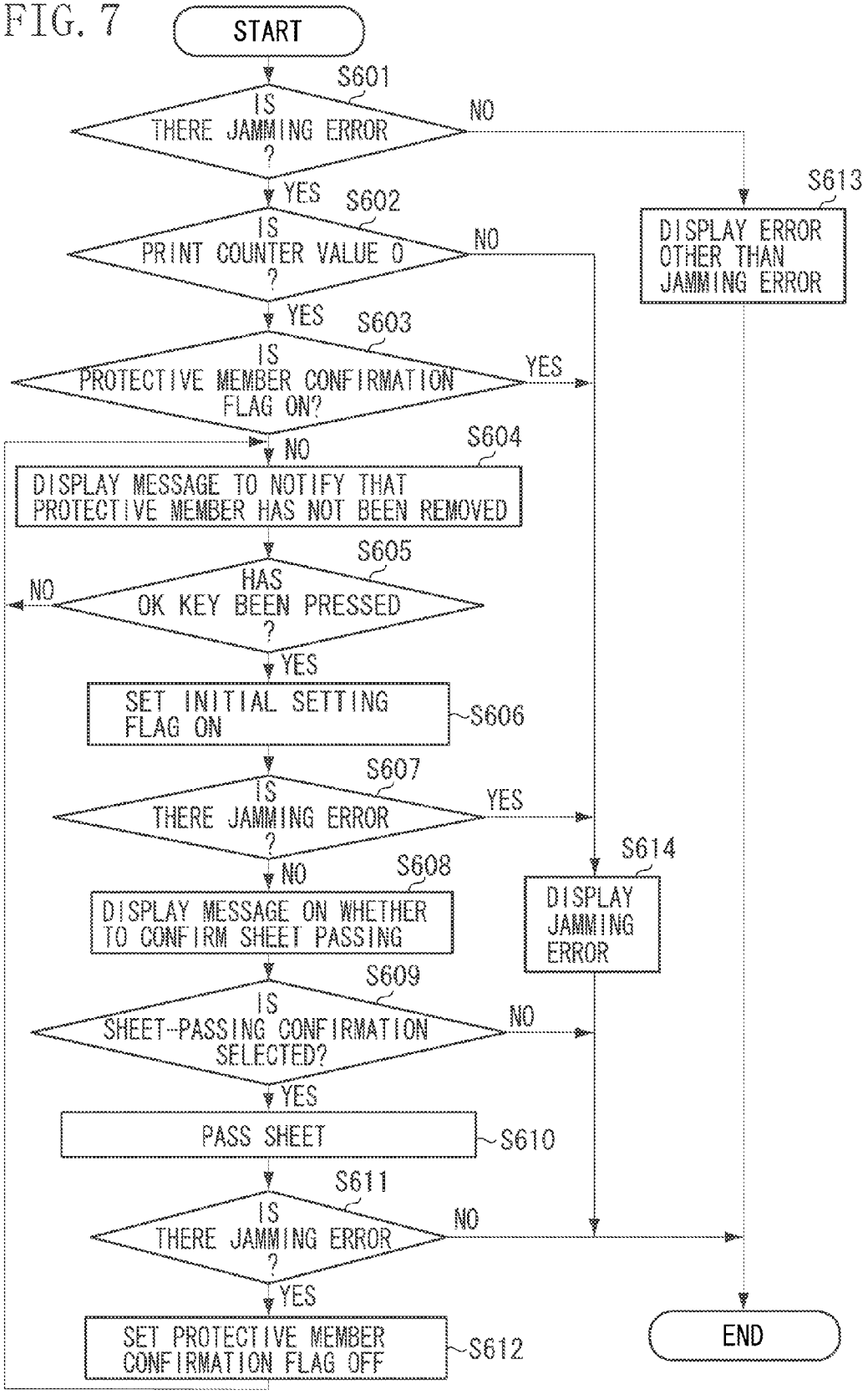
FIG. 7 is a flowchart illustrating a method for controlling the printing apparatus.

FIG. 7 is a flowchart illustrating a method for controlling the MFP 100 according to the present exemplary embodiment. This example is a control procedure of the error display processing in step S503 illustrated in FIG. 6. Each step is realized in such a manner that the CPU 101 loads the control program to the RAM 103 to execute the program.

In step S601, the CPU 101 determines whether a jamming error has occurred in the MFP 100. When it is determined that no jamming error has occurred (NO in step S601), then in step S613, the CPU 101 displays a message corresponding to the error on the display 108 to end the processing. For example, when an error caused due to no sheet occurs, the CPU 101 displays on the display 108 a message such as "No sheets in the sheet feeding cassette. Replenish sheets".

On the other hand, when it is determined that a jamming error has occurred (YES in step S601), then in step S602, the CPU 101 determines whether a value of the print counter 302 disposed in the RAM 103 is "0".

The value "0" of the print counter 302 indicates that a sheet has not been normally discharged. When it is determined that the value of the print counter 302 is "0" (YES in step S602), then in step S603, the CPU 101 determines whether setting of the protective member confirmation flag 304 disposed in the RAM 103 is "on". The protective member confirmation flag 304 provides information for managing a removal state of the protective member. When the CPU 101 receives an instruction in step S609 described below to determine that the protection member has been removed, the protective member confirmation flag is set to "on". When it is determined in step S611 that the protective member is yet to be removed, the protective member conformation flag is set to "off".

When it is determined that the setting of the protective member confirmation flag 304 is not "on" (NO in step S603), the CPU 101 determines that removal of the protective member by the user have not been confirmed, and the processing proceeds to step S604.

Then in step S604, the CPU 101 displays on the display 108 a message to notify that the protective member has not been removed. A message 702 illustrated in FIG. 5 is an example. The message 702 is displayed to notify the user that the protection member remains inside the apparatus, prompt the user to remove the protective member, and instruct the user to press the OK key via the PANEL 106 after the removal of the protective member.

In step S605, the CPU 101 determines whether the user has pressed the OK key on the PANEL 106. When it is determined that the user has not pressed the OK key (NO in step S605), the CPU 101 returns the processing to step S604 to display a message again to notify, to the user, that the protective member has not been removed.

On the other hand, when it is determined that the user has pressed the OK key (YES in step S605), then in step S606, the CPU 101 sets the setting value of the protective member confirmation flag 304 disposed in the RAM 103 to "on".

Then in step S607, the CPU 101 determines whether a jamming error has occurred based on an output of the sensor (not illustrated). If the user is yet to eliminate the jamming error that occurred at the time in step S602, the jamming error is still present. When it is determined that a jamming error has occurred (YES in step S607), then in step S614, the CPU 101 notifies the user of the occurrence of the jamming error, and displays, for example, a message 701 illustrated in FIG. 7 on the display 108 to end the processing.

If the user has eliminated the jamming error that occurred at the time in step S602, then in step S607, the CPU 101 determines that a jamming error has not occurred. Then in step S608, the CPU 101 displays on the display 108 a message 703 illustrated in FIG. 5 on whether to confirm sheet passing (conveyance processing), which is carried out to confirm the removal of the protective member. The message 703 instructs the user to press the OK key to execute sheet passing or to press a CLEAR key not to execute sheet passing.

Then in step S609, the CPU 101 determines whether an instruction of a sheet passing confirmation operation (conveyance instruction) has been received from the user. When it is determined that the instruction of a sheet passing confirmation operation has been received from the user (YES in step S609), then in step S610, the CPU 101 carries out processing for feeding a sheet, conveying the sheet via a sheet conveyance path, and discharging the sheet outside the apparatus. The CPU 101 carries out control to prevent printing of any image on this sheet. The CPU 101 can print, on the sheet, an image indicating that the sheet is used for a sheet passing confirmation operation according to the instruction before discharging the sheet, so that the user can easily know that the discharged sheet has been used to confirm whether the sheet is normally conveyed on the conveyance path in the MFP 100.

Then in step S611, the CPU 101 determines whether a jamming error has occurred during the sheet passing confirmation operation carried out in step S610. When the CPU 101 determines that a jamming error has not occurred during the sheet passing confirmation operation, the protective member is determined to have been removed, and thus the error display processing is ended.

On the other hand, when it is determined that a jamming error has occurred, the protective member is determined not to have been removed correctly. Thus, in step S612, the CPU 101 sets the setting value of the protective member confirmation flag 304 disposed in the RAM 103 to off. Then, the processing returns to step S604, and the CPU 101 displays on the display 108 a message to notify the user that the protective member has not been removed.

On the other hand, when it is determined that the instruction of a sheet passing confirmation operation has not been received from the user (NO in step S609), the CPU 101 ends the error display processing.

When it is determined that the value of the print counter 302 disposed in the RAM 103 is not "0" (NO in step S602), then in step S614, the CPU 101 displays on the display 108 a message to notify the user that a sheet jamming error has occurred. With a correctly recorded history, the CPU 101 determines that the user has removed the protective member, and notifies the user of an original sheet jamming error.

When it is determined that the setting of the protective member confirmation flag 304 disposed in the RAM 103 is ON (YES in step S603), in step S614, the CPU 101 similarly displays on the display 108 a message to notify the user that a jamming error has occurred.

Since it has been confirmed that the user has removed the protective member, the CPU 101 notifies the user of an original jamming error.

According to the present exemplary embodiment, without providing any sensor for directly detecting presence of the protective member, the printing apparatus can determine whether the error is attributed to the protective member that has not been removed, and then can make the notification to the user. This allows the user to recognize that the protective member is yet to be removed and to correctly remove the protective member, so that the user can correctly use the printing apparatus.

The present exemplary embodiment has been described by way of the example where the protective member is housed in the printing apparatus. However, the present exemplary embodiment can be applicable to an example of notifying the user that the protective member, which is housed in an apparatus including a sheet conveying unit such as a reading apparatus including an automatic document feeder, has not been removed. Thus, the present invention can also be applied to an apparatus including the reading apparatus, such as a multifunction peripheral or a facsimile apparatus.

In the case of the MFP 100 having no mechanism of displaying a message to prompt the user to remove the protective member at the time of power-ON, the CPU 101 executes the operation in step S402 illustrated in FIG. 4, and then executes the operation in step S407. Printing is carried out without removing the protective member illustrated in FIG. 2. When it is determined in step S602 that the value of the print counter is "0", the CPU 101 executes the operation in step S604 by skipping the operation in step S603 illustrated in FIG. 7. Accordingly, even in the case of the MFP 100 having no mechanism of displaying a message to prompt the user to remove the protective member at the time of power-ON, without installing any sensor for directly detecting presence of the protective member, the printing apparatus can determine whether the error is attributed to the protective member that has not been removed, and then can make the notification to the user.

The present exemplary embodiment has been described by way of the example where the CPU 101 notifies the user, based on whether the value of the print counter is "0", of the cause of the error, which is the protective member yet to be removed or the normal sheet jamming. Specifically, when the number of discharged sheets is less than a predetermined number (less than 1), the CPU 101 gives a message to the user to remove the protective member present on the conveyance path. On the other hand, when the number of discharged sheets is equal to or greater than the predetermined number (equal to or greater than 1), the CPU 101 notifies the user of sheet jamming. However, the present invention is not limited to this configuration. For example, the predetermined number is not limited to 1, but can be 2 or more. The predetermined number can be changed via the PANEL 106. Further, the invention is not limited to the case of storing the number of sheets. For example, when a predetermined number of sheets is correctly discharged, the CPU 101 can store a discharge flag in the RAM 103, and notify the user, based on the discharge flag, of the cause of the error, which is the protective member yet to be removed or the normal sheet jamming.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment (s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-029126 filed Feb. 14, 2012, which is hereby incorporated by reference herein in its entirety.

What is claimed is:

1. A printing apparatus which is enabled to convey a sheet by removing a protective member, comprising:

a detecting unit configured to detect a conveyance error of a sheet;

a notifying unit configured to perform a predetermined notification to a user, the predetermined notification being for notifying presence of the protective member; and a control unit configured to, in a case where the detecting unit detects a conveyance error of a sheet after conveyance of the sheet is started, control the notifying unit to perform the predetermined notification if no sheet has been discharged out of the printing apparatus.

2. The printing apparatus according to claim 1, wherein the control unit is further configured to, after the notifying unit performs the predetermined notification, control the notifying unit to perform, to the user, another notification which is for removing a sheet of the conveyance error and is different from the predetermined notification.

3. The printing apparatus according to claim 1, wherein the control unit is further configured to, in a case where the detecting unit detects the conveyance error, control the notifying unit to perform, to the user, another notification which is for removing a sheet of the conveyance error and is different from the predetermined notification without performing the predetermined notification if a sheet has been discharged out of the printing apparatus.

4. The printing apparatus according to claim 1, further comprising a counting unit configured to count a number of sheets discharged out of the printing apparatus, wherein the control unit is configured to judge whether or not a sheet has been discharged out of the printing apparatus, based on the number of sheets counted by the counting unit.

5. The printing apparatus according to claim 1, further comprising a storing unit configured to store information indicating that the user has confirmed the predetermined notification performed by the notifying unit, wherein the control unit is configured to, in a case where the detecting unit detects the conveyance error, not perform control for performing the predetermined notification if the storing unit stores the information, even if a sheet has not been discharged out of the printing apparatus.

6. The printing apparatus according to claim 1, wherein the protective member is placed on a sheet conveyance path.

7. The printing apparatus according to claim 1, wherein the protective member is for preventing a drum and a transfer roller which are used for printing from contacting with each other.

8. A method for controlling a printing apparatus which is enabled to convey a sheet by removing a protective, the method comprising:

detecting a conveyance error of a sheet;

performing a predetermined notification to a user, the predetermined notification being for notifying presence of the protective; and in a case where a conveyance error of a sheet is detected after conveyance of the sheet is started, controlling performing the predetermined notification if no sheet has been discharged out of the printing apparatus.

9. A non-transitory computer-readable storage medium storing a computer program that causes a computer to control a printing apparatus which enables to convey a sheet by removing a protective member, comprising:

a code to detect a conveyance error of a sheet;

a code to perform a predetermined notification to a user, the predetermined notification being for notifying presence of the protective member; and a code to, in a case where a conveyance error of a sheet is detected after conveyance of the sheet is started, control performing the predetermined notification, if no sheet has been discharged out of the printing apparatus.

* * * * *